US011913200B2

(12) United States Patent
Chung

(10) Patent No.: US 11,913,200 B2
(45) **Date of Patent: *Feb. 27, 2024**

(54) CONTAINER FILLING FAUCET

(71) Applicant: Kohler Co., Kohler, WI (US)

(72) Inventor: Chanseol Chung, Shanghai (CN)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/812,467

(22) Filed: Jul. 14, 2022

(65) Prior Publication Data

US 2022/0349161 A1 Nov. 3, 2022

Related U.S. Application Data

(63) Continuation of application No. 17/172,835, filed on Feb. 10, 2021, now Pat. No. 11,401,705, which is a continuation of application No. 16/284,697, filed on Feb. 25, 2019, now Pat. No. 10,947,708.

(60) Provisional application No. 62/636,324, filed on Feb. 28, 2018.

(51) Int. Cl.
*E03C 1/04* (2006.01)

(52) U.S. Cl.
CPC ..... *E03C 1/0404* (2013.01); *Y10T 137/9464* (2015.04)

(58) Field of Classification Search
CPC ..... E03C 1/0404; Y10T 137/9464
USPC ..... 137/801
See application file for complete search history.

(56) References Cited

U.S. PATENT DOCUMENTS

| | | | |
|---|---|---|---|
| 4,446,896 | A | 5/1984 | Campagna |
| 4,869,287 | A | 9/1989 | Pepper |
| 4,905,743 | A | 3/1990 | Gray |
| 4,917,155 | A | 4/1990 | Koblasz |
| 5,491,333 | A | 2/1996 | Skell |
| 5,549,273 | A | 8/1996 | Aharon |
| 5,782,035 | A | 7/1998 | Locke |
| 6,227,101 | B1 | 5/2001 | Rabadi |
| 6,305,267 | B1 | 10/2001 | Rolfes |
| 6,681,585 | B1 | 1/2004 | Stagg |
| 6,789,585 | B1 | 9/2004 | Janke |

(Continued)

FOREIGN PATENT DOCUMENTS

| | | |
|---|---|---|
| CN | 101688386 | 7/2012 |
| CN | 103574156 | 3/2016 |

(Continued)

OTHER PUBLICATIONS

CN Second Office Action CN Application No. 201910151779.X, dated Oct. 23, 2020, 16 pages.

(Continued)

*Primary Examiner* — Daphne M Barry
(74) *Attorney, Agent, or Firm* — Husch Blackwell

(57) ABSTRACT

A faucet includes a spout, a water level sensor, and a controller. The spout includes a water outlet having a first set of nozzles oriented at an angle with respect to a central axis defined by the water outlet such that water discharged from the first set of nozzles converges at the central axis at a focal distance from the water outlet. The water level sensor is disposed on the spout, and is configured to detect a distance between the water outlet and a level of water in a container disposed below the water outlet. The controller is configured to control the flow of water through the water outlet based on a comparison between the detected distance and the focal distance.

20 Claims, 8 Drawing Sheets

(56) References Cited

U.S. PATENT DOCUMENTS

| | | | |
|---|---|---|---|
| 7,059,342 | B2 | 6/2006 | Crimmins |
| 7,742,883 | B2 | 6/2010 | Dayton |
| 8,171,843 | B1 | 5/2012 | Heffington |
| 8,355,822 | B2 | 1/2013 | Jonte |
| 8,408,517 | B2 | 4/2013 | Jonte |
| 8,614,414 | B2 | 12/2013 | Davidson |
| 8,695,646 | B2 | 4/2014 | Agam |
| 8,994,812 | B2 | 3/2015 | Giordano |
| 9,470,563 | B1 | 10/2016 | DeVerse |
| 9,603,482 | B2 | 3/2017 | McHale |
| 10,947,708 | B2 | 3/2021 | Chung |
| 2010/0108165 | A1 | 5/2010 | Rodenbeck |
| 2016/0024766 | A1 | 1/2016 | Sawaski |
| 2016/0069053 | A1 | 4/2016 | Belz |
| 2016/0136659 | A1 | 5/2016 | Erickson |
| 2016/0137480 | A1 | 5/2016 | Ashrafzadeh |
| 2016/0207753 | A1 | 7/2016 | Choi |
| 2016/0355388 | A1 | 12/2016 | Willis |

FOREIGN PATENT DOCUMENTS

| | | |
|---|---|---|
| CN | 107477237 | 12/2017 |
| CN | 105597949 | 10/2018 |
| DE | 10 2012 221 456 | 5/2013 |
| WO | WO 2017006341 | 1/2017 |

OTHER PUBLICATIONS

Dutta 2016; Faucet Add-On Water Supply Management System Using Smart Sensors; 4 pgs.

Garun 2012; New GE Refrigerators Will Recognize When to Stop Filling Containers With Water; 14 pgs.

Chinese Third Office Action on CN Patent Application No. 201910151779.X dated Mar. 17, 2021 4 Pages.

Foreign Action other than Search Report on CN 201910151779.X dated Mar. 23, 2020.

CONTAINER FILLING FAUCET

PRIORITY CLAIM

The present application is a Continuation of U.S. application Ser. No. 17/172,835 filed Feb. 10, 2021, which is a Continuation of U.S. application Ser. No. 16/284,697 filed Feb. 25, 2019, which claims priority from U.S. Provisional Application No. 62/636,324, filed Feb. 28, 2018, each of which is hereby fully incorporated herein by reference in its entirety.

BACKGROUND

Faucets are typically controlled through a handle assembly including a valve. To initiate water flow, a user adjusts the orientation of the handle from an "off" position to open the valve. Once a desired amount of water has been discharged, the user re-orients the handle to the "off" position to prevent further flow. Such a process may render it difficult for users to precisely fill containers. For example, if the user orients the handle such that water flows from the faucet at a high rate, the user must shut the water flow off at just the right time to get the desired amount of water. Oftentimes, the user overfills the container and has to pour the excess water out of the container, wasting water.

SUMMARY

One embodiment relates to a faucet. The faucet includes a base, a spout, a water level sensor, and a controller. The spout is coupled to the base and includes a first portion proximate to the base and a second portion adjustable relative to the first portion. The second portion includes a water outlet. The water level sensor is disposed on the second portion, and is configured to detect a distance between the water outlet and a level of water in a container disposed below the water outlet. The controller is configured to control the flow of water through the water outlet based on the detected distance between the water outlet and the level of water.

Another embodiment relates to a faucet. The faucet includes a base, a spout, a water level sensor, and a controller. The spout is coupled to the base and includes a water outlet. The water outlet includes a first set of nozzles and a second set of nozzles. The first set of nozzles are oriented at an angle with respect to a central axis defined by the water outlet such that water discharged from the first set of nozzles reaches the central axis at a focal distance from the water outlet. The second set of nozzles are oriented substantially parallel to the central axis such that water discharged from the second set of nozzles is substantially parallel to the central axis. The water level sensor is disposed on the spout, and is configured to detect a distance between the water outlet and a level of water in a container disposed below the water outlet. The controller is configured to control the flow of water through the water outlet based on the detected distance between the water outlet and the level of water.

Another embodiment relates to a method of controlling the flow of water through a faucet. The method includes receiving, by a controller associated with the faucet, a first input to discharge water from a water outlet of the faucet until the water reaches a predetermined distance from the water outlet, wherein the water outlet includes a first set of nozzles and a second set of nozzles. The method further includes providing, by the controller in response to the first input, a control signal to a valve to discharge water from the first set of nozzles, wherein the first set of nozzles are oriented at an angle with respect to a central axis defined by the water outlet such that water discharged by the first set of nozzles reaches the central axis at the predetermined distance.

DETAILED DESCRIPTION OF THE DRAWINGS

Referring generally to the FIGURES, disclosed herein are faucets that include a water level sensor. The faucets also include a controller and multi-configuration spray head. The controller is configured to control flow through the spray head based on inputs received from a user as well as the water level sensor. Specifically, in response to an input indicating the presence of a container beneath an outlet assembly of the faucet, the controller is configured to provide a control signal to a flow control device (e.g., a valve, etc.) to discharge water via a first set of nozzles of the outlet assembly. The first set of nozzles may be oriented such that the discharged water converges to a point a predetermined distance from the outlet assembly.

Additionally, through the water level sensor, the controller tracks the level of water in the container and, upon the water level reaching the predetermined distance from the faucet, prevents further water flow from the faucet. As such, the converging water flow from the spray head provides the user with a visual indication as to the amount of water that will be dispensed. Additionally, since water flow automatically shuts off upon the water level reaching the desired level, the faucet disclosed herein facilitates the conservation of water by preventing users from overfilling containers.

Figure 1:
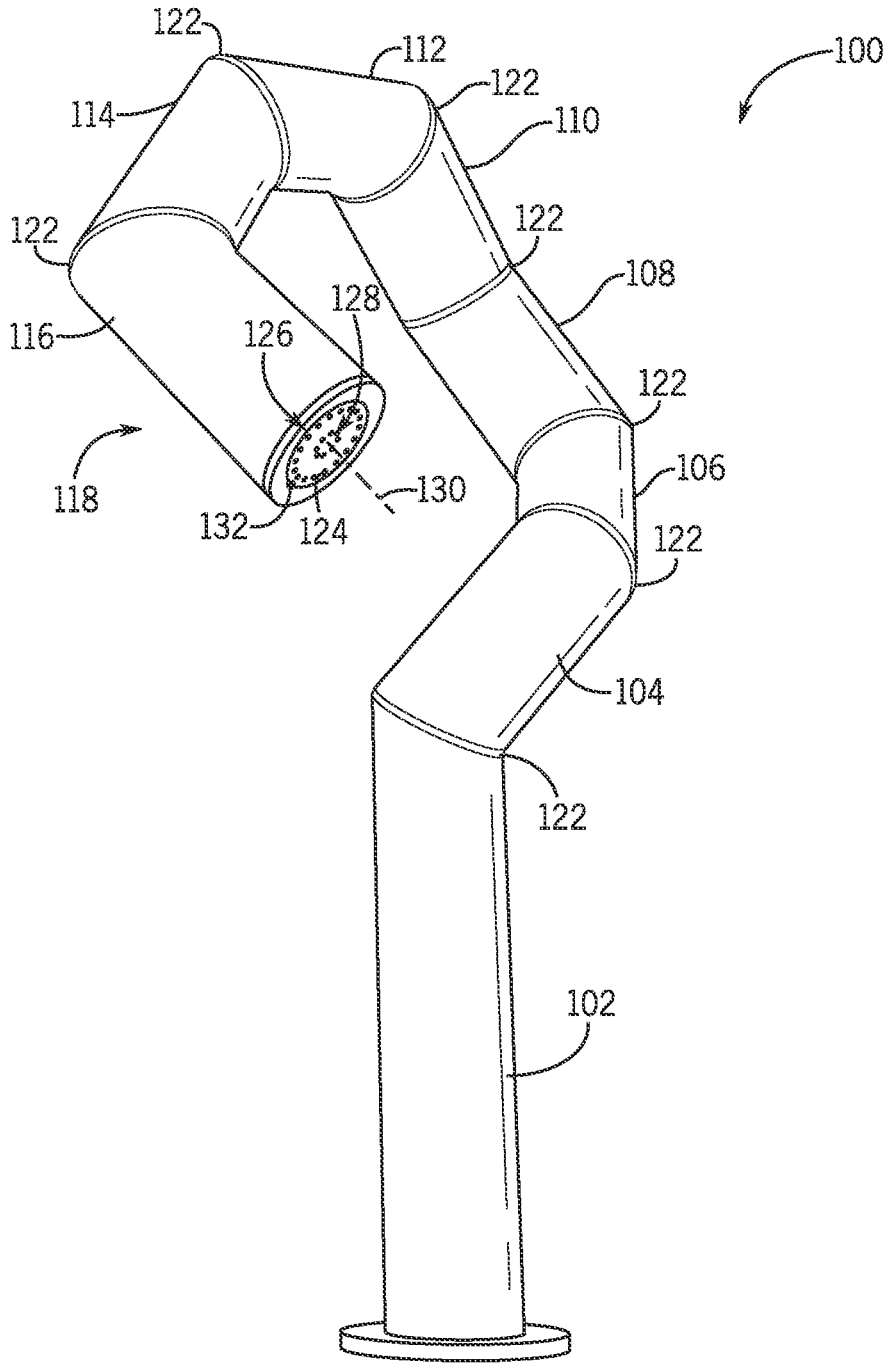
FIG. 1 is a perspective view of a faucet body according to an exemplary embodiment.

Referring now to FIG. 1 a faucet body 100 is shown, according to an example embodiment. It should be understood that the faucet body 100 is exemplary only. The present disclosure is applicable to any type of faucet body. In the example shown, the faucet body 100 includes eight segments 102, 104, 106, 108, 110, 112, 114, and 116. It should be understood that, in various alternative embodiments, the faucet body 100 may include any number of segments without departing from the scope of the present disclosure. For example, in one embodiment, the faucet body 100 includes only two segments.

As shown, each of the segments 102, 104, 106, 108, 110, 112, 114, and 116 is substantially cylindrical-shaped. The segments 102, 104, 106, 108, 110, 112, 114, and 116 each include a cavity defining a waterway through which water from a water supply may be provided to an outlet assembly 118 of the segment 116. For example, in one embodiment, the cavities of the segments 102, 104, 106, 108, 110, 112, 114, and 116 are substantially cylindrical-shaped to define a tubular waterway.

The outlet assembly 118 is configured to discharge water from the faucet body 100 to an area of interest (e.g., a sink basin, etc.) in response to various inputs described herein. As shown, the outlet assembly includes a spray head 124. In the embodiment shown, the spray head 124 includes a first set of nozzles 126 and a second set of nozzles 128. The spray head 124 also includes a valve assembly disposed therein to direct water to either the first set of nozzles 126 or the second set of nozzles 128. In various embodiments, the valve disposed within the spray head 124 is structured similar to that disclosed in U.S. patent application Ser. No. 14/547,913 filed on Nov. 19, 2014 and entitled "Multi-Function Spray-head," incorporated by reference herein in its entirety. For example, the valve may include a fluid inlet configured to receive water flowing through the waterway defined by the segments 102, 104, 106, 108, 110, 112, 114, and 116, a body that defines a first chamber and a second chamber, and a movable diverter. The diverter may be configured to be moved from a first configuration, in which the first set of nozzles 126 is fluidly coupled to the fluid inlet via the first chamber, and a second configuration, in which the second set of nozzles 128 is fluidly coupled to the fluid inlet via the second chamber. In one embodiment, the valve is a solenoid valve and is movable from the first configuration to the second configuration in response to control signals received from a controller. According to other exemplary embodiments, the valve assembly is located remotely from the spray head 124.

In some embodiments, the first set of nozzles 126 includes a plurality of openings in a cap that extend in a direction that is substantially parallel to a central axis 130 of the outlet assembly 118. In one embodiment, the first set of nozzles 126 are equally distributed throughout the cap. As such, when the valve is placed in the first configuration, water is discharged in a uniform flow including a plurality of individual streams travelling substantially parallel to the central axis 130. The second set of nozzles 128 includes another plurality of openings in the cap that extend at an angle to the central axis 130. In an embodiment, each nozzle in the second set of nozzles 128 is radially displaced from the central axis 130 and the angle is chosen such that axes of each of the nozzles intersects the central axis 130 a predetermined distance (herein referred to as the "focal distance") from the cap. As such, when the valve is placed in the second configuration, water is discharged in a flow including a plurality of individual streams that converge towards the central axis 130 until colliding with one another at the focal distance. As described herein, such an output flow may be used to indicate an eventual stopping point of the output flow to the user.

As shown in FIG. 1, the segment 116 further includes a water level sensor 132 disposed on an outer face thereof. In some embodiments, the water level sensor 132 includes a transmitter and a receiver. The transmitter is configured to discharge an electromagnetic signal (e.g., an ultrasonic signal) that reflects off a water surface (e.g., in a container beneath the outlet assembly 118) and is received by the transmitter. In various embodiments, the water level sensor 132 includes circuitry configured to calculate the delay between the emission of the electromagnetic signal and the receipt by the receiver. Based on the delay, the distance between the water level and the water level sensor 132 may be determined. As described herein, the controller may control water flow through the faucet based on the determined distance. For example, in one embodiment, the controller is configured to prevent further water flow (e.g., by closing an intake valve) through the faucet when the water level is a predetermined distance (e.g., the focal distance) from the water level sensor 132.

Still referring to FIG. 1, each of the segments 102, 104, 106, 108, 110, 112, 114, and 116 includes a tapered or angled end. At such angled ends, joints 122 are formed between successive ones of the segments 102, 104, 106, 108, 110, 112, 114, and 116. As described with respect to FIG. 4, in some embodiments, the angled ends include angular brackets including a set of magnetic elements therein that facilitate the rotation of segments 102, 104, 106, 108, 110, 112, 114, and 116 with respect to one another. Such rotation of individual ones of the segments facilitates placing the faucet body 100 in a number of different configurations.

Figure 3:
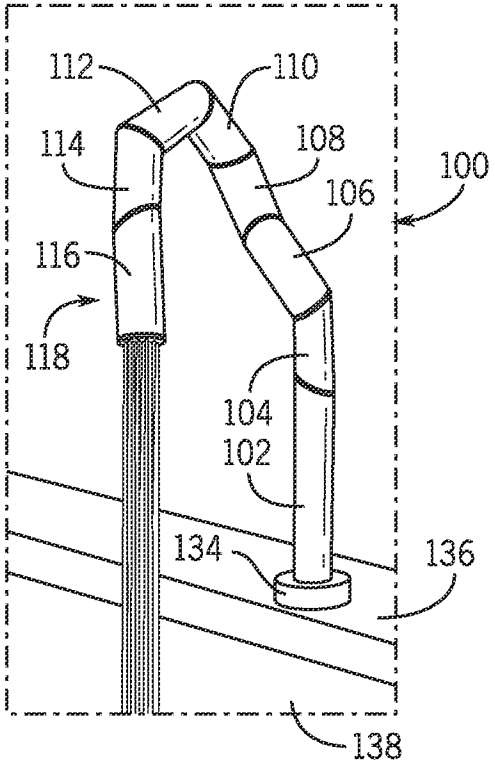
FIGS. 2-3 are perspective views of the faucet body shown in FIG. 1 in different configurations, according to various exemplary embodiments.
Figure 2:
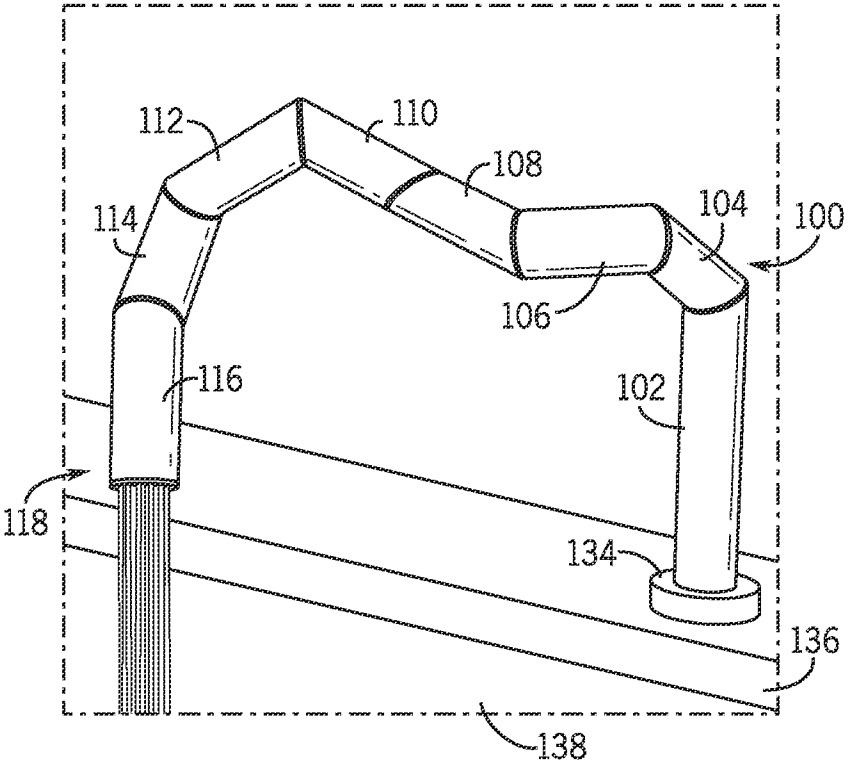

Referring now to FIGS. 2-3, perspective views where the faucet body 100 is mounted to a base 134 affixed to a mounting surface 136 (e.g., a counter top) are shown, according to example embodiments. For example, in various embodiments, the segment 102 is fixedly mounted to the base 134. In an alternative embodiment, the segment 102 is rotatably coupled to the base 134. As a result of the coupling with the base 134, water from the water supply is discharged from the outlet assembly 118 in response to an intake valve being placed in an open position. As shown, the valve of the outlet assembly 118 is placed in the first configuration such that a plurality of parallel streams are discharged upon turning water flow on. Additionally, the faucet body 100 extends over a basin 138 and discharges water into the basin 138. In various embodiments, a user may place a container (e.g., a pot, cup, bowl, etc.) beneath the outlet assembly 118 to fill the container.

In the configuration shown in FIG. 2, the segment 106 has been rotated with respect to the segment 104 such that the segment 106 extends in a direction that is substantially perpendicular to a direction of extension of the segment 102. Additionally, the segment 110 has been rotated such that the segment 110 extends substantially parallel to the segment 108. As such, the faucet body 100 extends a relatively large distance into or toward the basin 138. In the configuration shown in FIG. 3, the segment 104 has been rotated with respect to the segment 102 such that the segment 104 is inclined at a smaller angle than in the configuration shown in FIG. 2. Additionally, the segment 110 has been rotated with respect to the segment 108 such that the segment 110 extends at an angle to the segment 108. As a result, the outlet assembly 118 is higher above the basin 138 than in the configuration shown in FIG. 2.

Thus, the unique arrangement of the faucet body 100 enables the user to place the faucet body 100 in various configurations where the outlet assembly 118 is placed at different distances from a surface (e.g., a lower surface) of the basin 138. Such flexibility facilitates complete utilization of the water level sensor 132. As described herein, the controller is configured to close a water intake valve in response to a detected water level being a predetermined distance from the water outlet assembly 118. As such, the ability to rotate the segments 102, 104, 106, 108, 110, 112, 114, and 116 with respect to one another enables the user to fill up different containers to different water levels automatically, as described with respect to FIGS. 6-8.

It should be understood that the faucet body 100 may differ from the example depicted in FIGS. 1-3. For example, a faucet body of any external shape may include the outlet assembly 118 and the water level sensor 132 to provide the automatic container-filling functionalities described herein.

Figure 4:
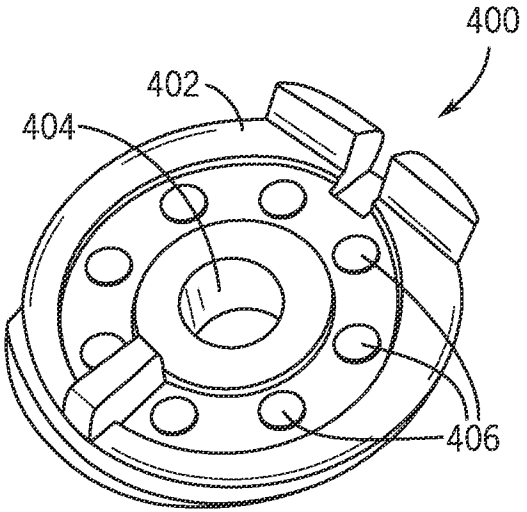
FIG. 4 is a perspective view of a magnetic joint used to rotatably couple segments of a faucet body to one another, according to an exemplary embodiment.

Referring now to FIG. 4, a joint member 400 is shown, according to an example embodiment. In various embodiments, each of the segments 102, 104, 106, 108, 110, 112, 114, and 116 of the faucet body 100 described with respect to FIG. 1 include structures similar to the joint member 400 at ends thereof that are adjacent to other ones of the segments 102, 104, 106, 108, 110, 112, 114, and 116. As such, two joint members may be disposed at each of the joints 122 described with respect to FIG. 1. As shown, the joint member 400 includes an annular shaped portion 402. The annular shaped portion 402 includes cavities having magnetic elements 406 disposed therein. The magnetic elements 406 are in some embodiments uniformly distributed throughout the annular shaped portion 402 in a circumferential direction.

In one embodiment, the magnetic orientation of the magnetic elements 406 for a particular joint member 400 is chosen based on the positioning of the joint member 400. For example, the magnetic elements 406 may be oriented such that like poles of the magnetic elements 406 of an adjacent joint member 400 (e.g., associated with another one of the segments 102, 104, 106, 108, 110, 112, 114, and 116) face one another. In such an arrangement, when adjacent segments 102, 104, 106, 108, 110, 112, 114, and 116 are rotated such that the magnetic elements 406 disposed in adjacent joint members 400 are aligned or substantially overlapping each another, the magnetic elements repel or bias away from one another, thereby facilitating further rotation of the segments with respect to one another. However, upon the user rotating a particular segment such that the magnetic elements 406 in adjacent joint members 400 are not aligned, the magnetic elements 406 attract or bias toward one another, thereby securely holding the segments 104, 106, 108, 110, 112, 114, and 116 in a fixed rotational position.

In some embodiments, the number of magnetic elements disposed in each joint member 400 decreases with proximity to the water outlet assembly 118. For example, in one embodiment, the joint members 400 disposed at the joint 122 between the segments 116 and 114 include two magnetic elements 406 and the joint members 400 disposed in the joint between the segments 102 and 104 include six magnetic elements 406. Such a difference is to account for the greater strain placed on the latter joint 122 due to the weight of the additional segments 104, 106, 108, 110, 112, 114, and 116 supported. Joints 122 between those previously described may have intermediate numbers of magnetic elements (e.g., the joint between the segments 112 and 110 may each include four magnetic elements 406). As such, segments closer to the base 134 are more difficult to rotate, but provide stronger mechanical support to the remaining segments.

The annular-shaped portion 402 also defines an inner cylindrical opening 404. In various embodiments, the inner cylindrical opening 404 is of a diameter that is similar to the inner openings enclosed by each of the segments 102, 104, 106, 108, 110, 112, 114, and 116. As such, the inner cylindrical openings 404 may be configured to hold a waterway tube configured to direct water received from a water source to the outlet assembly 118. In one embodiment, the diameter of the inner cylindrical openings 404 are chosen to house both a waterway tube and wiring for the water level sensor 132.

Figure 5:
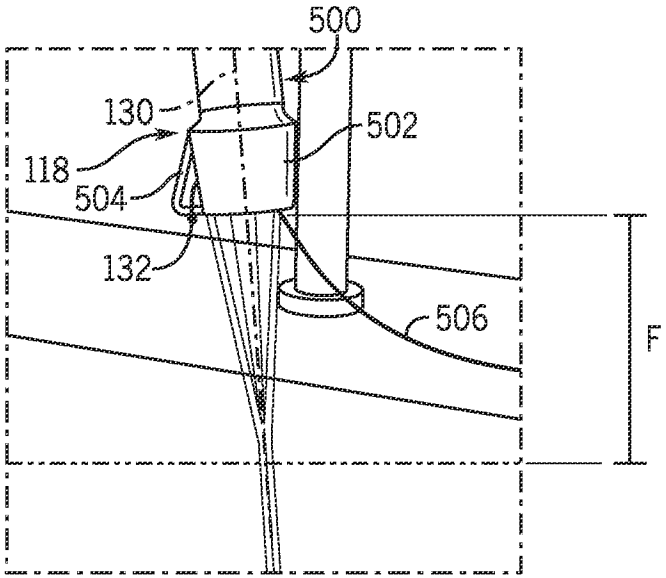
FIG. 5 is a perspective view of an end of a waterway tube including a water level sensor, according to an exemplary embodiment.

Referring now to FIG. 5, a portion of a waterway tube 500 is shown, according to an example embodiment. The waterway tube 500 may extend from an intake valve of the faucet assembly including the faucet body 100 and extend through each of the segments 102, 104, 106, 108, 110, 112, 114, and 116. As shown, the waterway tube 500 includes an end portion 502 having an initial diameter greater than the remainder of the waterway tube 500. The diameter of the end portion 502 gradually decreases with proximity to an end thereof. In one embodiment, the first and second sets of nozzles 126 and 128 are formed in the end portion 502. In the example shown, water is being discharged from the waterway tube 500 via the second set of nozzles 128, which extend substantially parallel to a contour defined by the outer surface of the end portion 502. As such, individual streams of water emerging from the second set of nozzles 128 converge at a focal distance F from the end of the waterway tube 500.

Also as shown, the water level sensor 132 is disposed on the end portion 502 of the waterway tube 500. For example, in some embodiments a structure (e.g., ledge) 504 is formed having a surface that extends substantially perpendicular to the central axis 130. The water level sensor 132 may be affixed to the surface via any method (e.g., an adhesive may be applied to the surface). In such embodiments, since the water level sensor 132 is disposed on the structure 504 that is displaced from an outer surface of the waterway tube 500, clearance is provided for wiring 506 associated with the water level sensor 132. For example, the wiring 506 may extend from the water level sensor 132 and be affixed to the outer surface of the waterway tube 500 prior to the insertion of the waterway tube 500 into the faucet body 100.

The wiring 506 is configured to provide sensor signals generated via the water level sensor 132 to a controller. Such sensor signals are indicative of the distance of a water level from the water level sensor 132. In some embodiments, upon such a signal indicating that the water level is the focal distance F away from the water level sensor 132, the controller is configured to close an intake valve so as to prevent further flow from the faucet. As such, the discharged stream of water provides the user with a visual indication as to level to which the faucet will fill a container.

Figure 6:
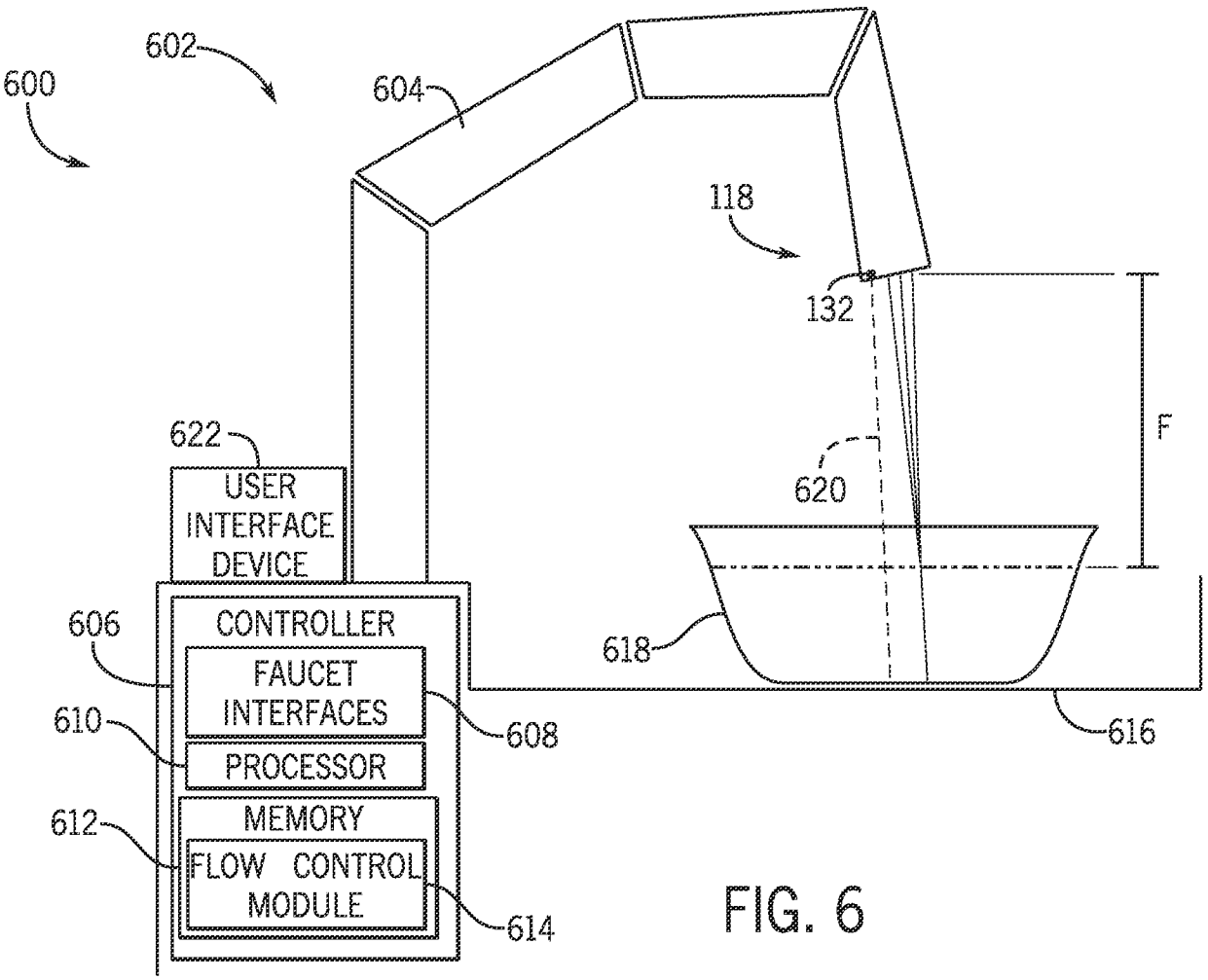
FIGS. 6-8 are schematic side views of a faucet including a system including a faucet, according various exemplary embodiments.

Referring now to FIG. 6, a schematic side view of a faucet system 600 is shown, according to an example embodiment. The faucet system 600 includes a faucet assembly 602, a controller 606, and a user interface device 622. The faucet assembly 602 includes a faucet body 604 in fluid communication with a water source via a base. In various embodiments, the faucet body 604 includes a structure similar to the faucet body 100 described with respect to FIGS. 1-5. Accordingly, like reference numerals may be used to aid in the description of the faucet body 604.

The faucet body includes the outlet assembly 118 and the water level sensor 132. As described herein the outlet assembly 118 includes a valve including a flow diverter configured to direct water received via an intake to either a first chamber or a second chamber. The first and second chambers are in fluid communication with separate sets of nozzles of the outlet assembly 118. Thus, through controlling the configuration of the valve, the form of the water output from the faucet body 604 may be adjusted.

The controller 606 is configured to receive various inputs and provide control signals to various components of the faucet system 600 based on the inputs. The controller 606 includes faucet interfaces 608, a processor 610, and a memory 612. The faucet interfaces 608 include various physical connections with various components of the faucet system 600. For example, via the faucet interfaces 608, the controller 606 may be communicably coupled to electrical control valves (e.g., a main intake valve, the valve of the outlet assembly 118) and the water level sensor 132 via various wires or cables associated with such elements. As such, the faucet interfaces 608 may include a plurality of jacks or soldered joints whereby such components are connected to the controller 606. Additionally, the faucet interfaces 608 may include a plurality of additional components such as analogue-to-digital converters configured to render signals received and provided by the controller 606 into an accessible form.

The controller 606 includes a processor 610 and a memory 612. Processor 610 may be a general purpose or specific purpose processor, an application specific integrated circuit (ASIC), one or more field programmable gate arrays (FPGAs), a group of processing components, or other suitable processing components. Processor 610 may be configured to execute computer code or instructions stored in memory 612 or received from other computer readable media (e.g., CD ROM, network storage, a remote server, etc.) to perform one or more of the processes described herein. Memory 612 may include one or more data storage devices (e.g., memory units, memory devices, computer-readable storage media, etc.) configured to store data, computer code, executable instructions, or other forms of computer-readable information. Memory 612 may include random access memory (RAM), read-only memory (ROM), hard drive storage, temporary storage, non-volatile memory, flash memory, optical memory, or any other suitable memory for storing software objects and/or computer instructions.

The user interface device 622 is configured to receive inputs from a user of the faucet system 600 to perform various operations described herein. The user interface device 622 may take a number of different forms in accordance with the present disclosure. While only a single user interface device is shown in FIG. 6, it should be understood that the faucet system 600 may include multiple user interface devices 622 in multiple forms. For example, in one embodiment, one user interface device comprises a button disposed proximate to the outlet assembly 118. The button may be mechanically coupled to the valve disposed therein, enabling the user to manually manipulate the flow output from the outlet assembly. Another user interface device 622 may include an electrical input device. Such a user interface may include a touch display or panel enabling the user to provide inputs to the faucet system to cause water to be discharged from the outlet assembly (e.g., similar to the outlet assembly 118 described with respect to FIG. 1). Yet another user interface device 622 may include a speaker including command recognition modules enabling the user to provide inputs to the faucet system 600 via various audible commands.

In some embodiments, the user interface device 622 (e.g., a button) enables the user to place the faucet into a filling mode. When placed into the filling mode, the controller 606 is configured to control the flow discharged by the faucet system 600 based on a water level sensed by the water level sensor 132.

In this regard, the memory 612 is shown to include a flow control module 614. The flow control module 614 is structured to cause the processor 610 to provide control signals to various components of the faucet system 600. For example, in one embodiment, in response to the user providing an input to place the faucet system 600 into a water filling mode, the controller 606 is configured to provide a first control signal to the outlet assembly 118 to cause a converging water flow to be discharged from the faucet body 604 (e.g., place the diverter into a second configuration to cause water to be discharged via the second set of nozzles 128). As shown, the converging water flow converges to a point a focal distance F from an emission face of the faucet body 604.

In some embodiments, at a time after receiving the user input to place the faucet system 600 into the water filling mode, the flow control module 614 causes the controller to change the flow output of the faucet. For example, upon the user depressing a filling mode button (or a predetermined time period thereafter), the flow control module 614 causes the valve of the outlet assembly 118 to change such that a uniform flow is discharged from the faucet. The uniform flow may have a higher rate than the converging flow, so as to more quickly fill a container 618 placed beneath the faucet body 604 in, for example, a faucet basin 616.

Additionally, the flow control module 614 may cause the processor 610 to monitor signals generated by the water level sensor 132 received via the faucet interfaces 608. For example, the processor 610 may receive signals indicative of a delay between the transmittal of an ultrasonic beam 620 discharged by the water level sensor 132 and the receipt of a reflected component of the ultrasonic beam 620. The delay may be compared with a threshold value (e.g., corresponding to a water level being the focal distance F from the water level sensor 132 or other component of the faucet body 604). In response to receiving an indication that the water level has reached the predetermined level, the flow control module 614 may cause the processor 610 to prevent further water flow by closing an electrical intake valve associated with the faucet system 600.

Figure 7:
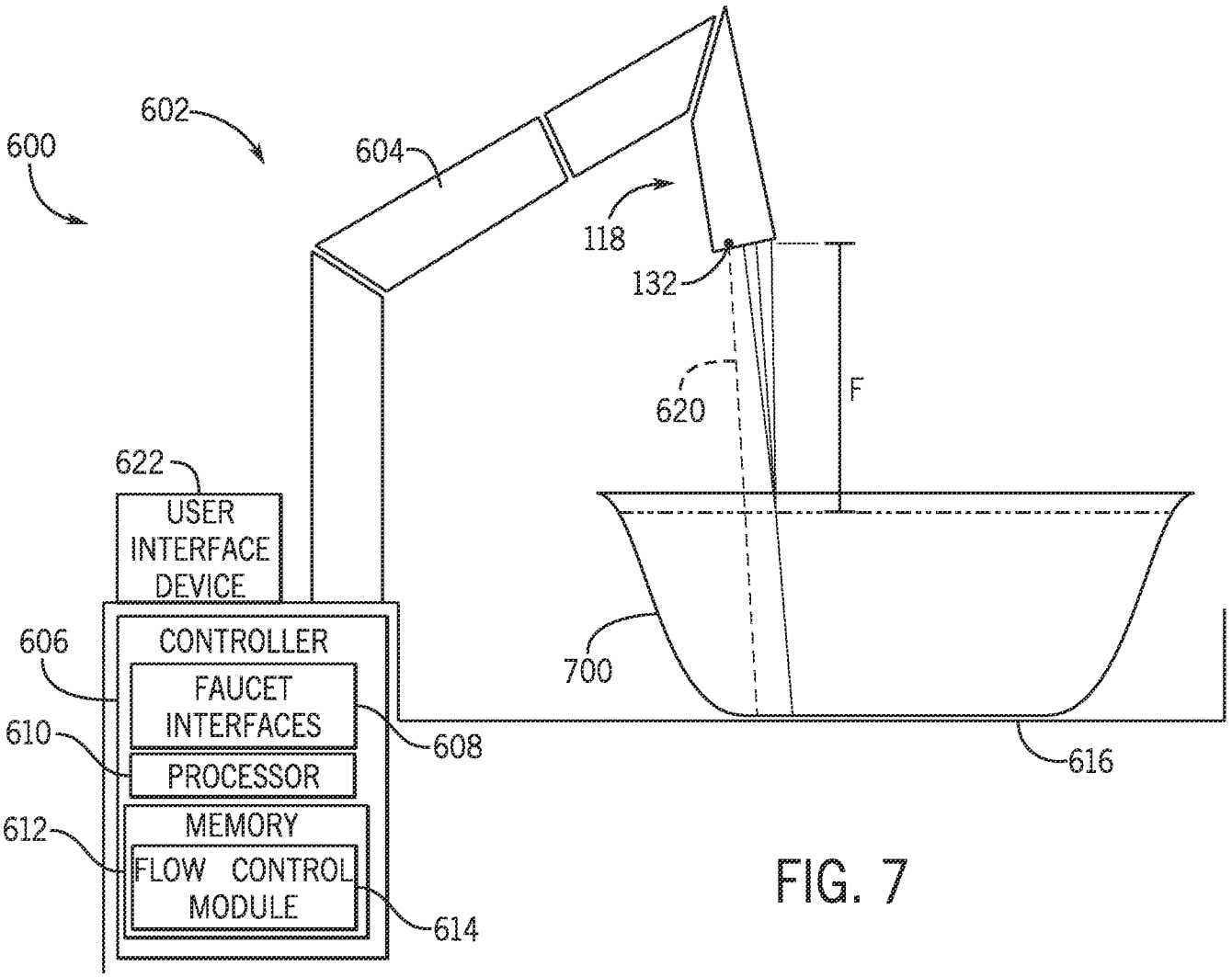

Referring now to FIG. 7, the faucet system 600 described with respect to FIG. 6 is shown, but has been placed into a different configuration. For example, the user may have rotated various segments of the faucet body 604 with respect to one another, so as to change the height of the water level sensor 132 with respect to the faucet basin 616. As a result, the focal distance F is also displaced by the amount the faucet body 604 was adjusted. Due to this adjustment, the user may fill a container 700 that is larger than the container 618 described with respect to FIG. 6 to the same level. As such, the adjustable nature of the faucet body 604 facilitates multiple volumes of containers being filled to different levels.

Figure 8:
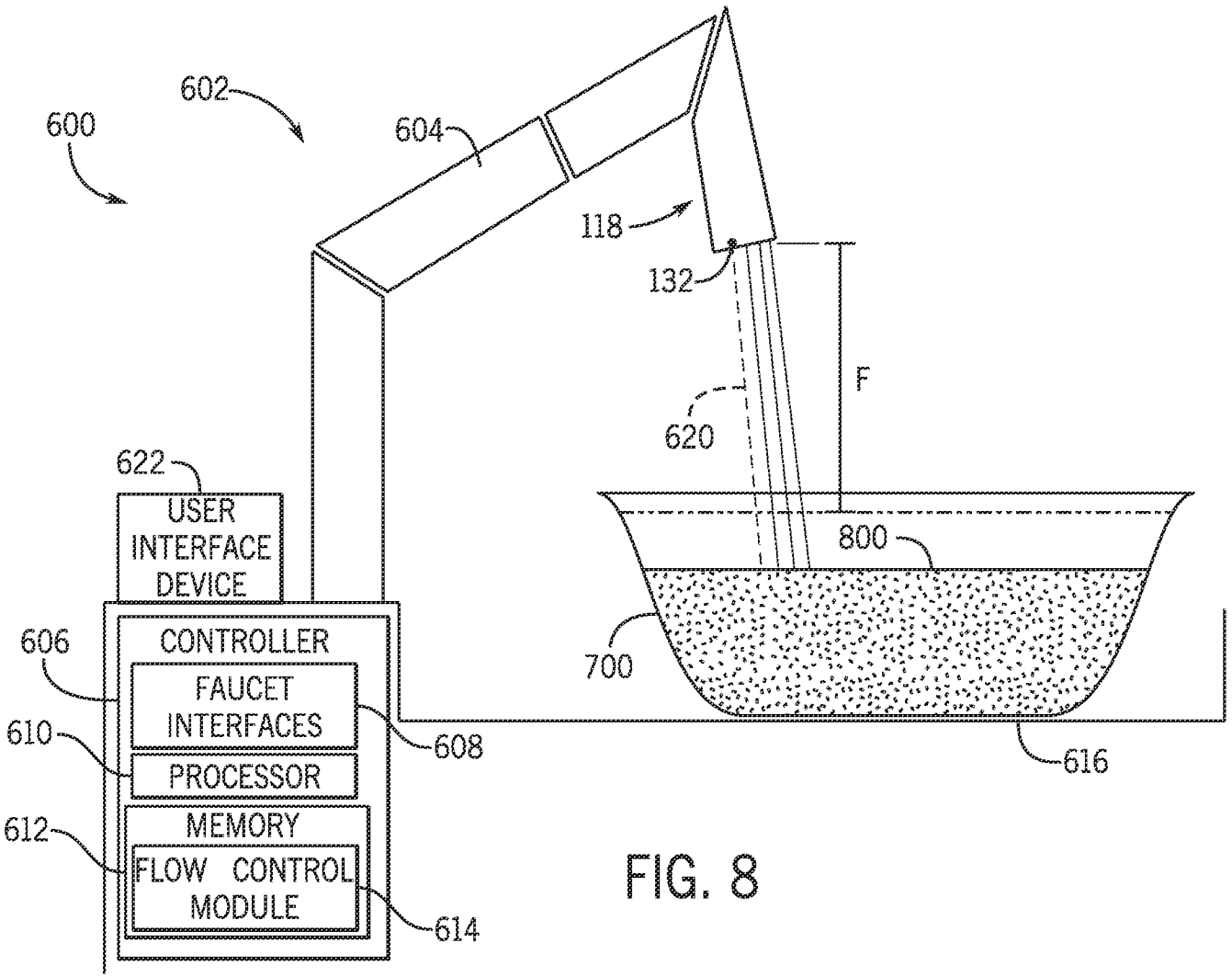

Referring now to FIG. 8, the configuration of the faucet system 600 is shown at a later time, according to an example embodiment. As shown, the controller 606 has placed the outlet assembly 118 into a configuration such that an evenly distributed spray (e.g., through the first set of nozzles 126) is discharged. A volume of water has been received in the container 700 such that a top water level 800 is beneath the focal distance F. As such, upon the controller receiving an indication of the water level 800 from the water level sensor 132, the depicted flow state of the discharged water will be maintained until the water level 800 reaches the focal distance F. At this point, the controller 606 will automatically prevent further flow from the faucet. As such, the user does not need to actively monitor the status of the water level 800.

Figure 9:
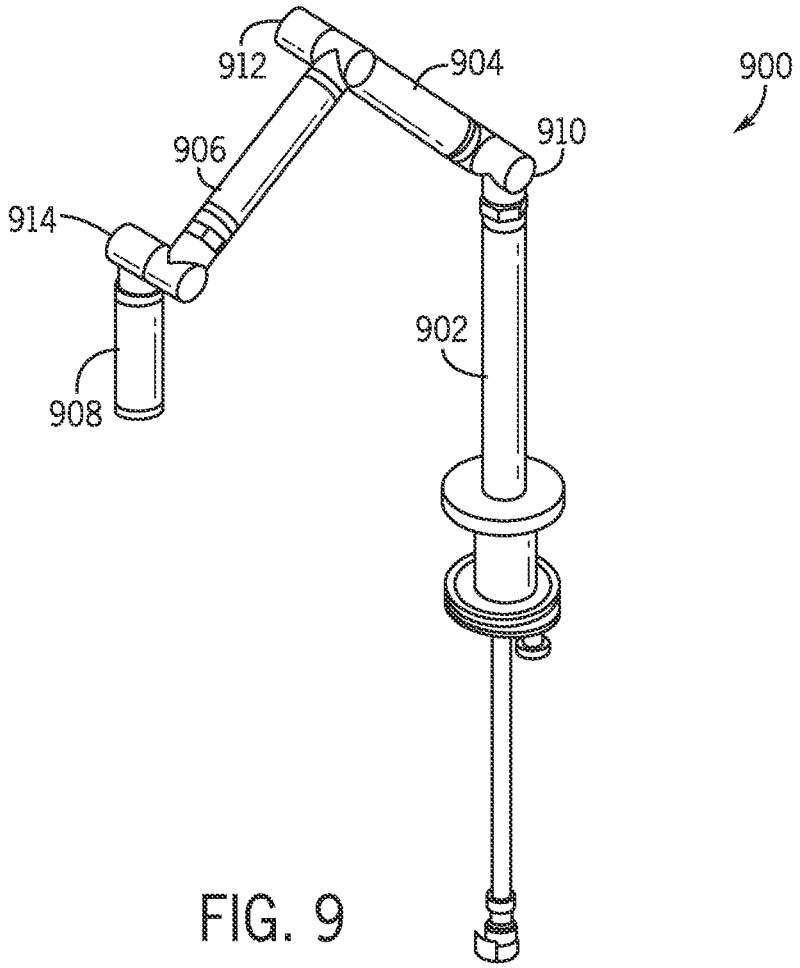
FIG. 9 is a perspective view of an articulating faucet, according to an exemplary embodiment.

Referring now to FIG. 9, a faucet body 900 is shown, according to an example embodiment. The faucet body 900 may serve as an alternative to the faucet body 100. In various embodiments, the faucet body 900 may include any of structures and features described in U.S. Pat. No. 9,568,132 entitled "Clutched Joint for Articulating Faucet," incorporated by reference herein in its entirety. In summary, instead of including a plurality of segments that are each rotatable with respect to one another as in the faucet body 100, the faucet body 900 includes a first segment 902, a second segment 904, a third segment 906, and a spray head 908 that are adjustable with respect to one another. The spray head 908 may be configured to produce an adjustable flow output as well as include a water level sensor similar to the outlet assembly 118 described with respect to FIG. 1.

The segments 902, 904, 906, and 908 are coupled to one another via joints 910, 912, and 914. Each of the joints 910, 912, and 914 includes two housings: one attached to each of the respective segments 902, 904, 906, and 908 that are coupled at the associated joint 910, 912, and 914. Such housings are rotatably coupled to one another via a clutch assembly, such that the segments 902, 904, 906, and 908 may be moved in a plane extending through the center of the faucet body 900. As such, the spray head 908 may be changed in height, enabling the user to fill up various containers to a desired level in accordance with the systems and methods described herein.

Figure 10:
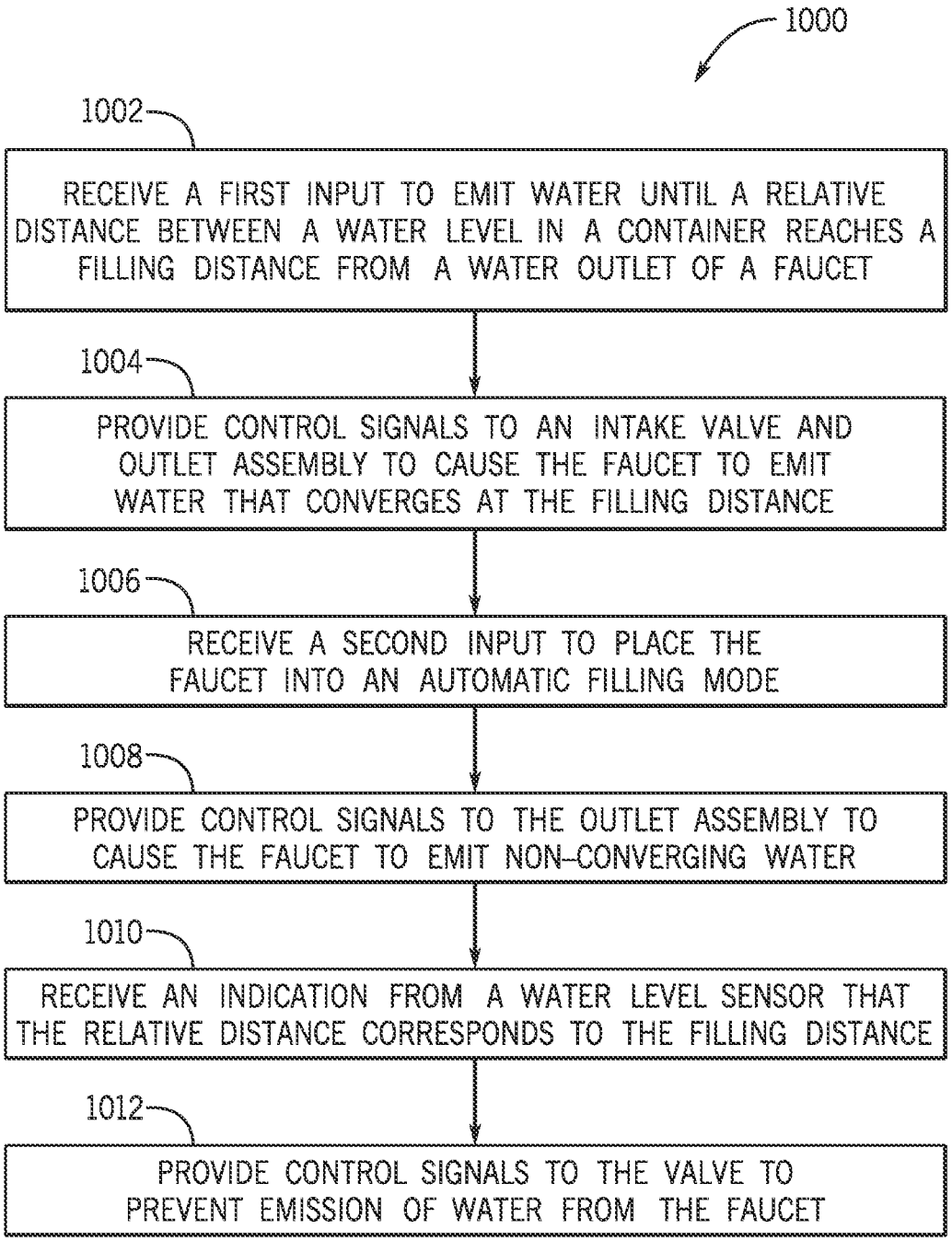
FIG. 10 is a flow diagram of a method of controlling the flow of a faucet to fill a container to a desired level, according to an exemplary embodiment.

Referring now to FIG. 10, a flow diagram of a method 1000 for operating a faucet is shown, according to an example embodiment. Method 1000 may be executed by, for example the controller 606 of the faucet system 600 described with respect to FIGS. 6-8. For example, method 1000 may be executed to automatically fill a container to a desired level.

In an operation 1002, a first input to discharge water until a relative distance between a water level in a container reaches a filling distance from a water outlet of a faucet is received. For example, a user of the faucet system 600 may provide such an input via the user interface device 622. In an illustrative example, a user may press a filling mode button to place the faucet system 600 into a filling mode. When in the filling mode, the controller 606 operates the faucet in a manner to facilitate the user filling a container beneath the outlet assembly 118 to a desired level. To this end, the controller 606 is configured to place the outlet assembly 118 into a configuration in which a converging water flow is discharged upon receipt of a flow emission input from the user (e.g., by providing a control signal to an electrical diverter valve placed in the outlet assembly 118). Such a flow emission input may be provided in a number of ways. For example, such an input may be provided simultaneously with the first input (i.e., the first input may cause the faucet to discharge water). Alternatively, the user may provide such an input via the user interface device 622, which may include a multifunctional display or panel configured to receive any of the user inputs described herein. Additionally, such a water emission input may be provided via a proximity sensor or handle assembly associated with the faucet assembly 602.

In various embodiments, the converging water flow converges to a point that is a predetermined distance (e.g., the focal distance F) from the outlet assembly 118. In some embodiments, the predetermined distance is fixed (e.g., five inches from the outlet assembly 118) based on the angular disposition of the second set of nozzles 128 of the outlet assembly 118 and not adjustable by the user.

Also when placed in filling mode via the first input, the controller 606 is configured to monitor a water level sensed via the water level sensor 132. As described herein, the controller 606 is configured to control the flow discharged by the faucet assembly 602 based on a sensed water level in a container beneath the faucet assembly 602. For example, in one implementation, the controller 606 is configured to prevent water flow upon the sensed water level reaching a filling distance. In some embodiments, the filling distance corresponds to the focal distance F and is not adjustable. That way, the converging water flow provides the user with an exact visual representation of the height where further water flow is prevented. In such embodiments, to adjust the filling level, the user adjusts the relative height of the outlet assembly through adjustments of portions of the faucet assembly 602. In alternative embodiments, the filling distance is offset from the focal distance. In such embodiments, the filling distance may be adjustable by the user (e.g., the user interface device 622 may include a portion enabling the user to adjust the offset). This way, the user may adjust the filling distance without adjusting the relative height of the outlet assembly 118.

In an operation 1004, control signals are provided to a valve and outlet assembly to cause the faucet to discharge a converging water flow. For example, the controller 606 may generate control signal to an electrical valve placed in the outlet assembly 118 so as to cause water received via an inlet to be directed to the second set of nozzles 128. As such, upon receipt of the water emission input from the user, water is discharged in a plurality of individual streams that converge at the filling distance. At this point, while the converging water flow is discharged, the user may adjust the relative height of the outlet assembly 118 such that the focal distance F is at a desired fill level in the container.

In an operation 1006, a second input to place the faucet into an automatic filling mode is received. The user may provide such an input in a similar manner as the first input was provided in operation 1002. For example, in one embodiment, the user may de-press the filling mode button so as to indicate that the faucet has been placed in a configuration (e.g., a desired height) such that the point at which the discharged water converges corresponds to a desired filling level in the container. In an operation 1008, in response to receiving the second input, control signals are provided to the outlet assembly to cause the faucet to discharge non-converging water. For example, a control signal may be provided to the diverter in the outlet assembly 118 to cause water from the inlet to be discharged through the first set of nozzles 126.

In an operation 1010, an indication is received from a water level sensor that the relative distance between the outlet and the water level in the container corresponds to the filling distance. For example, the controller 606 may monitor the level of water in the container by measuring the delay between the transmittal and receipt of an ultrasonic signal and, based on the delay, determine that the relative distance corresponds to the filling distance. In an operation 1012, control signals are provided to a valve to prevent further emission of water from the faucet. As such, the faucet automatically fills the container to a desired level without the user needing to attend to the amount of water dispensed.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIG- URES. It should be noted that the orientation of various elements may differ according to other exemplary embodiments, and that such variations are intended to be encompassed by the present disclosure.

The construction and arrangement of the elements of the faucet as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or resequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

The invention claimed is:

1. A fluid delivery device, comprising:

an outlet having a first set of nozzles oriented parallel to the central axis such that fluid discharged from the first set of nozzles is parallel to the central axis;

a sensor configured to detect a distance between the outlet and a level of fluid in a container disposed below the outlet; and a controller configured to control the flow of fluid through the outlet based on a comparison between the detected distance and a predetermined distance from the outlet, wherein the controller is configured to stop the flow of fluid when the fluid reaches the predetermined distance from the outlet.

2. The fluid delivery device of claim 1, further comprising a base and a spout coupled to the base, wherein the spout includes a first portion proximate to the base, and a second portion adjustable relative to the first portion, and wherein the second portion includes the outlet.

3. The fluid delivery device of claim 1, wherein the outlet includes a second set of nozzles oriented at an angle with respect to the central axis such that fluid discharged from the second set of nozzles converges at the central axis at a focal distance from the outlet.

4. The fluid delivery device of claim 3, wherein the controller is further configured to:

receive a first input to discharge fluid from the outlet until a relative distance between the level of fluid in the container and the outlet of the fluid delivery device corresponds to the predetermined distance; and provide, in response to the first input, a control signal to a valve to discharge fluid from the first set of nozzles.

5. The fluid delivery device of claim 4, wherein the controller is further configured to:

receive a second input that the container has been placed below the outlet; and provide, in response to the second input, a control signal to the valve to discharge fluid from the second set of nozzles.

6. The fluid delivery device of claim 5, wherein the controller is further configured to:

receive, by the sensor, an indication that the relative distance corresponds to the predetermined distance; and provide, in response to the indication, a control signal to the valve to prevent fluid from being discharged from the outlet.

7. The fluid delivery device of claim 1, wherein controlling the flow of fluid through the outlet includes closing a valve in response to the detected distance reaching the predetermined distance.

8. The fluid delivery device of claim 7, wherein the predetermined distance is fixed irrespective of the distance between the outlet and a mounting surface of the fluid delivery device.

9. A fluid delivery device, comprising:

an outlet, wherein the outlet includes a first set of nozzles and a second set of nozzles, wherein the first set of nozzles are oriented at an angle with respect to a central axis defined by the outlet such that fluid discharged from the first set of nozzles converges at the central axis at a focal distance from the outlet, and wherein the second set of nozzles are oriented parallel to the central axis such that fluid discharged from the second set of nozzles is parallel to the central axis;

a sensor configured to detect a distance between the outlet and a level of fluid in a container disposed below the outlet; and a controller configured to control the flow of fluid through the outlet based on a comparison between the detected distance and the focal distance.

10. The fluid delivery device of claim 9, wherein the controller is further configured to:

receive a first input to discharge fluid from the outlet until a relative distance between the level of fluid in the container and the outlet corresponds to the focal distance; and provide, in response to the first input, a control signal to a valve to discharge fluid from the first set of nozzles.

11. The fluid delivery device of claim 10, wherein the controller is further configured to:

receive a second input that the container has been placed below the outlet; and provide, in response to the second input, a control signal to the valve to discharge fluid from the second set of nozzles.

12. The fluid delivery device of claim 11, wherein the controller is further configured to:

receive, by the sensor, an indication that the relative distance corresponds to the focal distance; and provide, in response to the indication, a control signal to the valve to prevent fluid from being discharged from the outlet.

13. The fluid delivery device of claim 9, further comprising a base and a spout coupled to the base, wherein the spout includes a first portion proximate to the base and a second portion adjustable relative to the first portion.

14. The fluid delivery device of claim 9, wherein controlling the flow of fluid through the outlet includes closing a valve in response to the distance reaching a predetermined distance threshold.

15. The fluid delivery device of claim 14, wherein the predetermined distance threshold is fixed irrespective of the distance between the outlet and a mounting surface of the fluid delivery device.

16. A method of controlling a flow of fluid from a fluid delivery device, the method comprising:

receiving, by a controller associated with the fluid delivery device, a first input to discharge fluid from a outlet of the fluid delivery device until the fluid reaches a predetermined distance from the outlet, wherein the outlet includes a first set of nozzles; and providing, by the controller in response to the first input, a control signal to a valve to discharge fluid from the first set of nozzles, wherein the first set of nozzles are oriented at an angle with respect to a central axis defined by the outlet such that fluid discharged by the first set of nozzles converges at the central axis at the predetermined distance.

17. The method of claim 16, further comprising:

receiving, by the controller, a second input; and providing, by the controller in response to the second input, a control signal to a valve to discharge fluid from a second set of nozzles of the outlet, wherein the second set of nozzles are oriented parallel to the central axis such that the discharged fluid travels parallel to the central axis.

18. The method of claim 17, further comprising:

receiving, by a sensor, an indication that a fluid level in the container is at the predetermined distance from the outlet; and providing, in response to the indication, a control signal to the valve to prevent fluid from being discharged from the outlet.

19. The method of claim 18, wherein the first input and the second input are received from a user input device.

20. The method of claim 16, wherein the fluid delivery device includes a base and a spout coupled to the base, wherein the spout includes a first portion proximate to the base and a second portion adjustable relative to the first portion, and wherein the second portion includes the outlet.

* * * * *